US005988417A

United States Patent [19]

Cheng et al.

[11] Patent Number: 5,988,417

[45] Date of Patent: Nov. 23, 1999

[54] PLASTIC CONTAINER HAVING IMPROVED RIGIDITY

[75] Inventors: Jizu J. Cheng, Burr Ridge; Jeffrey D. Krich, Orland Park, both of Ill.

[73] Assignee: Crown Cork & Seal Technologies Corporation, Alsip, Ill.

[21] Appl. No.: 08/967,130

[22] Filed: Nov. 12, 1997

[51] Int. Cl.[6] ..... B65D 1/02; B65D 23/00

[52] U.S. Cl. ..... 215/383; 215/382; 215/373; 220/606; 220/608; 220/671; 220/675

[58] Field of Search ..... 220/608, 606, 220/673, 675, 671; 215/373, 375, 383, 382, 370, 371

[56] References Cited

U.S. PATENT DOCUMENTS

| | | | |
|---|---|---|---|
| D. 68,489 | 10/1925 | Miller | D9/552 |
| D. 75,426 | 6/1928 | Jasper | D9/556 |
| D. 85,379 | 10/1931 | Fuerst | D9/556 |
| D. 115,782 | 7/1939 | Cobb | D9/566 |
| D. 117,138 | 10/1939 | Buckingham | D9/571 |
| D. 120,277 | 4/1940 | Steelman | D9/552 |
| D. 197,925 | 4/1964 | Allen | D9/571 |
| D. 204,711 | 5/1966 | Plummer | D9/552 |
| D. 205,099 | 6/1966 | Plummer | D9/571 |
| D. 216,080 | 11/1969 | Lawton | D9/571 |
| D. 219,432 | 12/1970 | Edwards | D7/523 |
| D. 230,136 | 1/1974 | Strand | D9/552 |
| D. 264,435 | 5/1982 | Pettengill | D9/553 |
| D. 286,985 | 12/1986 | Durand | D9/553 |
| D. 305,984 | 2/1990 | Alberghini et al. | D9/500 |
| D. 306,262 | 2/1990 | Bit | D9/520 |
| D. 369,556 | 5/1996 | Launder et al. | D9/553 |
| D. 394,813 | 6/1998 | Homsy | D9/551 |
| 3,357,593 | 12/1967 | Sears, Jr. et al. | 220/673 X |
| 3,403,804 | 10/1968 | Colombo | 215/375 X |
| 4,294,366 | 10/1981 | Chang | 215/375 |
| 4,512,490 | 4/1985 | Frei et al. | 220/673 |
| 4,538,439 | 9/1985 | Frei | 220/673 X |
| 4,966,780 | 10/1990 | Hargraves et al. | 215/375 X |
| 5,071,015 | 12/1991 | Kinslow | 215/375 |
| 5,092,475 | 3/1992 | Krishnakumar et al. | 215/383 X |
| 5,101,990 | 4/1992 | Krishnakumar et al. | 215/383 |
| 5,222,615 | 6/1993 | Ota et al. | 215/383 X |
| 5,224,614 | 7/1993 | Bono et al. | 215/384 |
| 5,499,730 | 3/1996 | Harbour | 215/382 |
| 5,522,519 | 6/1996 | Bergner et al. | 215/382 |
| 5,529,196 | 6/1996 | Lane | 215/375 |
| 5,593,056 | 1/1997 | Mero et al. | 215/382 |
| 5,642,826 | 7/1997 | Melrose | 215/382 |
| 5,645,190 | 7/1997 | Goldberg | 220/674 |
| 5,690,244 | 11/1997 | Darr | 215/382 |
| 5,704,504 | 1/1998 | Bueno | 215/382 X |
| 5,740,934 | 4/1998 | Brady | 215/382 X |
| 5,746,339 | 5/1998 | Petre et al. | 215/382 |
| 5,785,197 | 7/1998 | Slat | 215/375 |

FOREIGN PATENT DOCUMENTS

| | | | |
|---|---|---|---|
| 1207681 | 7/1986 | Canada | 215/382 |

*Primary Examiner*—Sue A. Weaver
*Attorney, Agent, or Firm*—Woodcock Washburn Kurtz Mackiewicz & Norris LLP

[57] ABSTRACT

A plastic container that is designed for optimal strength and lightweighting characteristics includes a finish portion, a bottom portion that has a plurality of support feet and a corresponding number of grooves defined between the support feet, and a main body portion. According to one feature of the container, the main body portion has at least one groove defined in its smooth label area that is oriented so as to have an axial component and so as to extend to near a bottom of the label portion for permitting condensate to drain from the label portion. This reduces the potential for condensation-induced label delamination. According to another feature of the container, the main body portion further has a tapered neck portion that has a plurality of undulating grooves defined therein to provide structural reinforcement. The main body of the container also has a lower end that is configured so as to have a number of generally axially extending channels that extend toward the bottom portion. Some of these channels merge into the grooves, and others terminate before reaching the bottom portion. The channels provide a structural reinforcement effect, whereby enhanced structural reinforcement of said lower end is achieved without increasing the number of support feet and grooves.

34 Claims, 3 Drawing Sheets

PLASTIC CONTAINER HAVING IMPROVED RIGIDITY

BACKGROUND OF THE INVENTION

1. Field of the Invention

This invention relates broadly to the field of container making, and more specifically to blow molded plastic bottles, such as the PET bottles that are in common use today for packaging soft drinks such as soda.

2. Description of the Related Technology

During the last twenty-five years or so, there has been a dramatic shift in the packaging of beverages, such as bottled water and soft drinks, away from glass containers and toward plastic containers. Polyethylene terephthalate (PET) is in wide use throughout the world for such containers because it exhibits such preferred characteristics as high toughness, light weight, high transparency, high pressure resistance and acts as a good gas barrier.

The packaging industry is highly competitive, and economic pressure exists to encourage lightweighting (e.g. minimizing the amount of plastic material that is used) the container as much as possible. As a practical matter, the amount of lightweighting that can be achieved is limited by the necessary design strength of the container. In particular, each container must have a certain minimum axial strength, which refers to strength against forces that may be applied in a direction that is parallel to the axis of the container, and a minimum hoop strength, which is defined as strength against forces that may be applied circumferentially against the outer wall of the container. Another factor that is important is the rigidity that the container exhibits against deformation as a result of being gripped or squeezed.

Typically, such containers have a central smooth label area to which a label is pasted or applied by means of a pressure sensitive adhesive. One problem that sometimes exists is that condensation can collect between the container and the label, thereby acting to weaken the bond and delaminate the label from the container. Any improvement that will tend to reduce or eliminate this problem should be well received in the industry.

In general, containers tend to be stabilized against rocking and tipping if they have support feet that provide a large foot surface area for supporting the container on an underlying surface. It is easier to provide for a large amount of foot surface area by minimizing the number of support feet, because this also minimizes the number of grooves that separate the feet on the bottom of the container. Unfortunately, minimizing the number of support feet and associated grooves also tends to reduce the axial strength and hoop strength of the container wall in the area that is immediately above the support feet.

A need exists for an improved container design that optimizes strength and lightweighting potential, that reduces the potential for condensate to collect between the container and a label, and that maximizes foot surface area without materially reducing the axial strength and hoop strength of the container wall in the area that is immediately above the support feet.

SUMMARY OF THE INVENTION

It is therefore an object of the invention to provide an improved container design that optimizes strength and lightweighting potential, that reduces the potential for condensate to collect between the container and a label, and that maximizes foot surface area without materially reducing the axial strength and hoop strength of the container wall in the area that is immediately above the support feet.

In order to achieve the above and other objects of the invention, a plastic container that is designed to reduce the potential for label delamination as a result of the formation of condensate includes a finish portion; a bottom portion; and a label portion positioned between the finish portion and the bottle portion; the label portion having a generally smooth outer surface; and at least one groove that is defined in the outer surface, the groove being oriented so as to have an axial component and extending to near a bottom of the label portion for permitting condensate that may form on the smooth outer surface to drain from the label portion in order to reduce the potential for condensation-induced label delamination to occur.

According to a second aspect of the invention, a plastic container that is designed for optimal stability against tipping and strength in the area that is immediately above the support feet includes a finish portion; a bottom portion including a plurality of support feet and a corresponding number of grooves defined between the support feet; and a main body portion having an upper end that is connected to the finish portion and a lower end that is connected to the bottom portion, the lower end being configured so as to have a number of generally axially extending channels that extend toward the bottom portion, and wherein some of the channels merge into the grooves, and others terminate before reaching the bottom portion, and wherein the channels have a structural reinforcement effect, whereby enhanced structural reinforcement of the lower end is achieved without increasing the number of support feet and grooves.

According to a third aspect of the invention, a plastic container that is designed for optimal strength and lightweighting characteristics includes a finish portion;
a bottom portion; and a main body portion having an upper end that is connected to the finish portion and a lower end that is connected to the bottom portion, the upper end including a tapered neck portion; and wherein the tapered neck portion has a plurality of undulating grooves defined therein to provide structural reinforcement to the tapered neck portion.

According to a fourth aspect of the invention, a plastic container that is designed for optimal strength and lightweighting characteristics includes a finish portion; a bottom portion including a plurality of support feet and a corresponding number of grooves defined between the support feet; and a main body portion, the main body portion having a label portion positioned between the finish portion and the bottle portion; the label portion having a generally smooth outer surface; and at least one groove that is defined in the outer surface, the groove being oriented so as to have an axial component and extending to near a bottom of the label portion for permitting condensate that may form on the smooth outer surface to drain from the label portion in order to reduce the potential for condensation-induced label delamination to occur; the main body portion further having an upper end that is connected to the finish portion and a lower end that is connected to the bottom portion, the upper end including a tapered neck portion; and wherein the tapered neck portion has a plurality of undulating grooves defined therein to provide structural reinforcement to the tapered neck portion; the lower end of the main body portion being configured so as to have a number of generally axially extending channels that extend toward the bottom portion, and wherein some of the channels merge into the grooves, and others terminate before reaching the bottom portion, and wherein the channels have a structural reinforcement effect, whereby enhanced structural reinforcement of the lower end is achieved without increasing the number of support feet and grooves.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
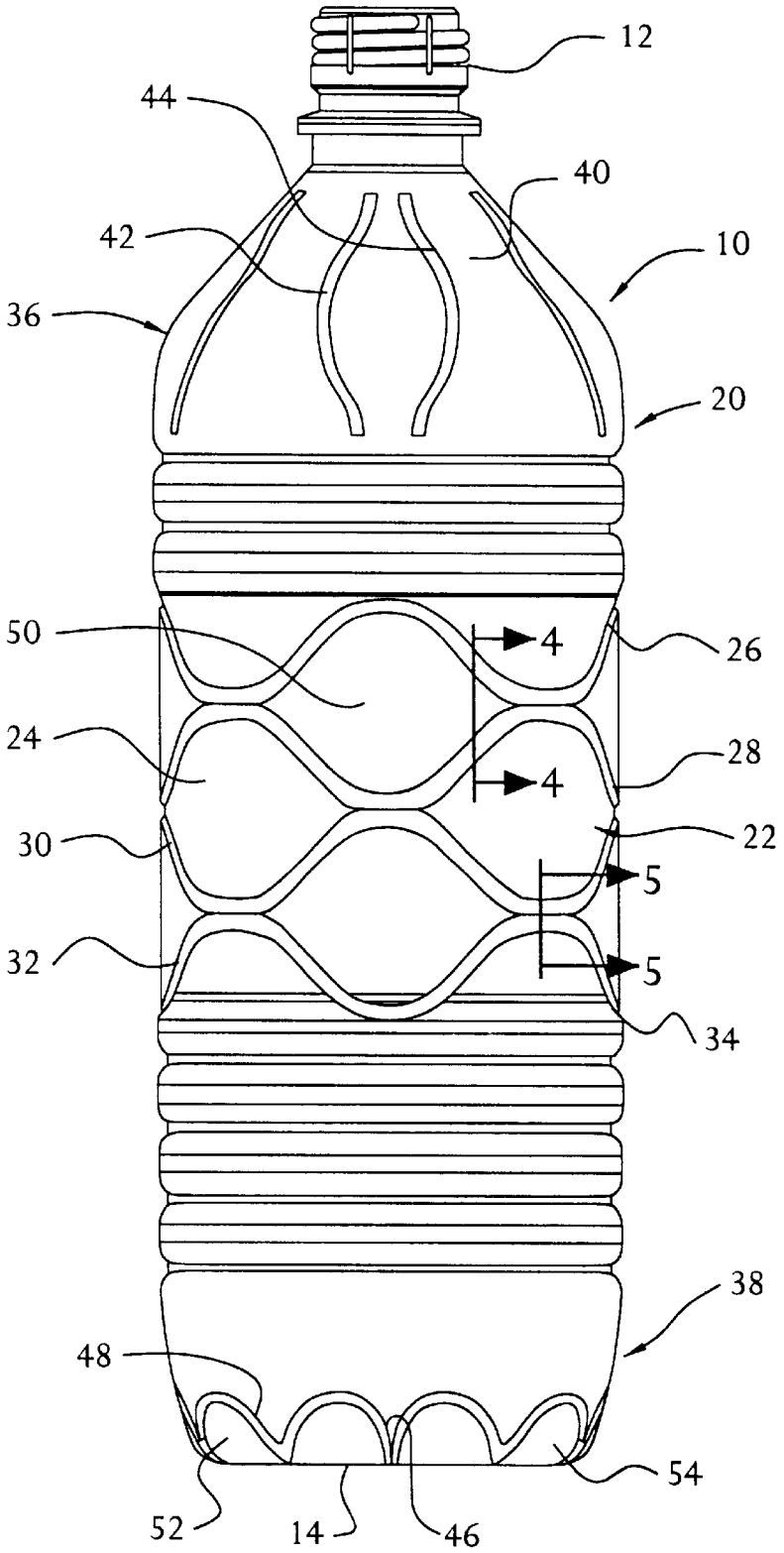
FIG. 1 is a front elevational view of a container that is constructed according to a preferred embodiment of the invention.
Figure 2:
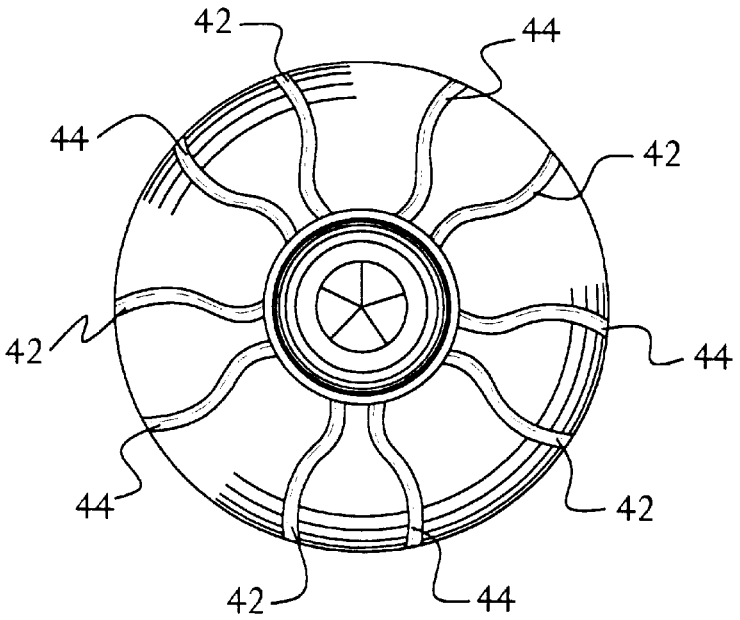
FIG. 2 is a top plan view of the container shown in FIG. 1.
Figure 3:
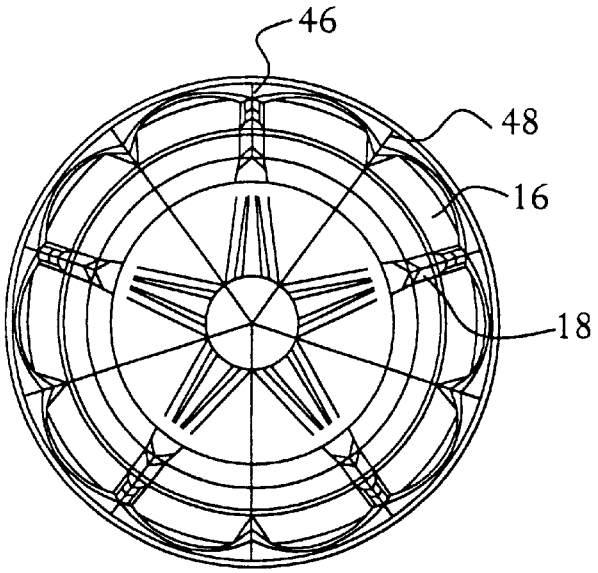
FIG. 3 is a bottom plan view of the container shown in FIGS. 1 and 2.

Referring now to the drawings, wherein like reference numerals designate corresponding structure throughout the views, and referring in particular to FIG. 1,
a plastic container 10 that is designed for optimal strength and lightweighting characteristics includes a conventional finish portion 12, and a bottom portion 14 that, as is best shown in FIG. 3, includes a plurality of support feet 16 and a corresponding number of grooves 18 that are defined between the support feet 16. Container 10 further includes a main body portion 20 that has a label portion 22 positioned between the finish portion 12 and the bottom portion 14.

As may be seen in FIG. 1, the label portion 22 has a generally smooth outer surface 24 and at least one groove that is defined in the outer surface 24. The groove(s) is oriented so as to have an axial component and so as to extend to near a bottom 34 of the label portion 22 in order to permit condensate that may form on the smooth outer surface 24 to drain from the label portion 22 so as to reduce the potential for condensation-induced label delamination. A label (not shown) will be secured by conventional means such as pasting or pressure sensitive adhesive to the smooth outer surface 24 of the label portion 22.

Figure 4:
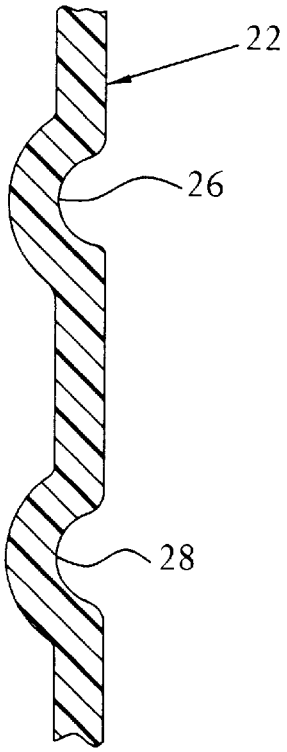
FIG. 4 is a fragmentary cross-sectional view taken along lines 4—4 in FIG. 1.
Figure 5:
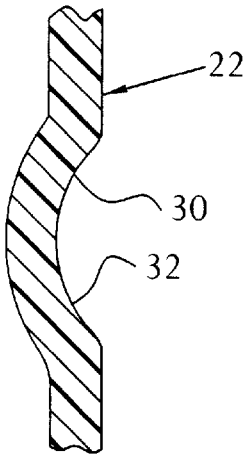
FIG. 5 is a fragmentary cross-sectional view taken along lines 5—5 in FIG. 1.

As may also be seen in FIG. 1, the groove(s) preferably are embodied as a plurality of undulating grooves 26, 28, 30, 32 that serve to strengthen the label portion 22. The grooves 26, 28, 30, 32 are preferably interconnected so as to permit efficient drainage of condensate. In the preferred embodiment, the grooves 26, 28, 30, 32 are generally circumferentially oriented and are generally sinusoidal in shape.
The grooves 26, 28, 30, 32 also preferably periodically contact each other, thereby defining cells 50 in the label portion 22 that structurally reinforce the label portion 22 against deformation. This is done in the preferred embodiment by making adjacent sinusoidal grooves out of phase so as to contact and merge with the adjacent groove at the top and bottom of the sinusoidal convex curves. This is best seen by comparing FIGS. 4 and 5. FIG. 4 is a fragmentary cross-sectional view taken along lines 4—4 in FIG. 1, while FIG. 5 is a fragmentary cross-sectional view taken along lines 5—5 in FIG. 1. As may be seen in FIG. 4, adjacent grooves 26, 28 are separately defined in the label portion 2 at locations where the grooves 26, 28 have not yet reached their peaks. In FIG. 5, however, which is taken through the peak portions of the adjacent grooves 30, 32, the grooves are in communication with each other, which will allow condensate to drain from the upper groove 30 to the lower groove 32. The presence of the grooves 26, 28, 30 and 32 also substantially reinforces the label portion 22 in terms of axial strength, hoop strength, and in rigidity when gripped. It does so, moreover, without adversely affecting the surface of the container to which the label will be affixed, as would a protruding reinforcing rib, for example.

Turning to another aspect of the invention, it will be seen that the main body portion 20 further has an upper end 36 that is connected to the finish portion 12, and a lower end 38 that is connected to the bottom portion 14 of the container 10. As may be seen in FIG. 1, the upper end 36 includes a tapered neck portion 40 which advantageously has a plurality of undulating grooves 42, 44 defined therein to provide structural reinforcement to the tapered neck portion 40. The undulating grooves 42, 44 have both an axial component and a circumferential component, and are preferably oriented generally axially. Grooves 42, 44 are also preferably generally sinusoidal, and are also preferably out of phase so that concave surfaces of each of the respective grooves 42, 44 face each other. In other words, each set of grooves 42, 44 defines a reinforcement couple. The presence of the grooves 42, 44 substantially reinforces the tapered neck portion 40, in terms of axial strength, hoop strength, and rigidity when gripped.

Yet another aspect of the invention involves the lower end 38 of the main body portion 20 being configured so as to have a number of generally axially extending channels 46, 48 that extend toward the bottom portion 14. As may be seen in FIGS. 1 and 3, some of said channels (those with reference numeral 46) merge into a groove 18 on bottom portion 14, and others (those with reference numeral 48) terminate before reaching the bottom portion 14. All of the channels 46, 48 have a structural reinforcing effect on the lower end of the main body portion 38. By providing more of the channels 46, 48 than are necessary given the number of grooves 18 in the bottom portion 14 (specifically the additional channels 48), this structural reinforcement is enhanced. Described in another way, the present design permits a greater number of reinforcing channels while minimizing the number of grooves 18 in the bottom portion 14. By so minimizing the number of grooves 18, the surface area of the support feet 16 can be kept higher, thus making the container more stable against rocking or tipping. For aesthetic reasons, all of said channels 46, 48 have substantially the same appearance when viewed from the side while the container 10 is standing. This creates the illusion of having more support feet 16 than the container 10 actually has.

As may be seen in FIG. 1, the channels 46, 48 define a number of discrete panels 54 on the lower end 38 of the main body portion 20. Each of the panels further preferably has a lower end 52 that merges into one of the support feet 16. Preferably. the panels 54 have a generally arcuate shape that is concave as viewed from the bottom portion 14 toward the finish portion 12. As may be seen in FIG. 1, the arcuate shaped are aligned so as to create a generally sinusoidal pattern that has a reinforcing effect. This reinforcing effect improves the hoop strength, the axial strength and the crush strength of the lower end 38 of the main body portion 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A plastic container that is designed to reduce the potential for label delamination as a result of the formation of condensate, comprising:

a finish portion;

a base portion; and a label portion positioned between said finish portion and said base portion, said label portion having a top, bottom, and generally smooth outer surface; and at least one groove formed in said label portion outer surface, said groove being oriented so as to have an axial component and extending below said bottom of said label portion for permitting condensate that may form on said label portion smooth outer surface to drain from said label portion in order to reduce the potential for condensation-induced label delamination to occur.

2. A container according to claim 1, further comprising a label that is secured to said smooth outer surface of said label portion.

3. A container according to claim 1, wherein said at least one groove comprises a plurality of undulating grooves that serve to strengthen said label portion, said grooves being interconnected so as to permit efficient drainage of condensate.

4. A container according to claim 3, wherein said undulating grooves are generally circumferentially oriented.

5. A container according to claim 4, wherein said undulating grooves are generally sinusoidal in shape.

6. A container according to claim 3, wherein said undulating grooves are generally sinusoidal in shape.

7. A container according to claim 6, wherein said sinusoidal grooves periodically contact each other, thereby defining cells in said label portion that structurally reinforce said label portion against deformation.

8. A container according to claim 3, wherein said undulating grooves periodically contact each other, thereby defining cells in said label portion that structurally reinforce said label portion against deformation.

9. A plastic container that is designed for optimal stability against tipping and strength in the area that is immediately above the support feet, comprising:

a finish portion;

a bottom portion including a plurality of support feet and a corresponding number of grooves defined between said support feet; and a main body portion having an upper end that is connected to said finish portion; and a lower end that is connected to said bottom portion, said lower end being configured so as to have a number of generally axially extending channels that extend toward said bottom portion, and wherein some of said channels merge into said grooves, and others terminate before reaching said bottom portion, and wherein said channels have a structural reinforcement effect, whereby enhanced structural reinforcement of said lower end is achieved without increasing the number of support feet and grooves.

10. A container according to claim 9, wherein all of said channels have substantially the same appearance when viewed from the side while the container is standing, whereby the illusion of having more support feet than the container actually has is created.

11. A container according to claim 9, whereby said channels define a number of discrete panels on said lower end of said main body portion, and wherein each of said panels has a lower end that merges into one of said support feet, each of said panels having a generally arcuate shape.

12. A container according to claim 11, wherein said arcuate shape is concave as viewed from the bottom portion toward the finish portion.

13. A container according to claim 11, wherein said arcuate shaped panels are aligned so as to create a generally sinusoidal pattern that has a reinforcing effect.

14. A plastic container that is designed for optimal strength and lightweighting characteristics, comprising:

a finish portion;

a bottom portion; and a main body portion having an upper end that is connected to said finish portion and a lower end that is connected to said bottom portion, said upper end including a tapered neck portion, wherein said tapered neck portion has a plurality of undulating grooves defined therein to provide structural reinforcement to said tapered neck portion, said undulating grooves being oriented generally axially and being generally sinusoidal.

15. A plastic container according to claim 14, wherein adjacent grooves are out of phase so that concave surfaces thereof face each other, thereby defining coupled reinforcement.

16. A plastic container that is designed for optimal strength and lightweighting characteristics, comprising:

a finish portion;

a base portion including a plurality of support feet and a corresponding number of grooves defined between said support feet; and a main body portion, said main body portion having a label portion positioned between said finish portion and said base portion, said label portion having a top, bottom, and generally smooth outer surface; and at least one groove formed in said label portion outer surface, said groove being oriented so as to have an axial component and extending below said bottom of said label portion for permitting condensate that may form on said label portion smooth outer surface to drain from said label portion in order to reduce the potential for condensation-induced label delamination to occur;

said main body portion further having an upper end that is connected to said finish portion and a lower end that is connected to said base portion, said upper end including a tapered neck portion; and wherein said tapered neck portion has a first set of a plurality of undulating grooves defined therein to provide structural reinforcement to said tapered neck portion;

said lower end of said main body portion being configured so as to have a number of generally axially extending channels that extend toward said base portion, and wherein some of said channels merge into said grooves, and others terminate before reaching said base portion, and wherein said channels have a structural reinforcement effect, whereby enhanced structural reinforcement of said lower end is achieved without increasing the number of support feet and grooves.

17. A container according to claim 16, further comprising a label that is secured to said smooth outer surface of said label portion.

18. A container according to claim 16, wherein said at least one groove comprises a second set of a plurality of undulating grooves that serve to strengthen said label portion, said grooves being interconnected so as to permit efficient drainage of condensate.

19. A container according to claim 18, wherein said second set of undulating grooves are generally circumferentially oriented.

20. A container according to claim 19, wherein said second set of undulating grooves are generally sinusoidal in shape.

21. A container according to claim 20, wherein said second set of undulating grooves periodically contact each other, thereby defining cells in said label portion that structurally reinforce said label portion against deformation.

22. A container according to claim 18, wherein said second set of undulating grooves periodically contact each other, thereby defining cells in said label portion that structurally reinforce said label portion against deformation.

23. A container according to claim 16, wherein said first set of undulating grooves are generally sinusoidal in shape.

24. A container according to claim 23, wherein adjacent grooves of said first set of undulating grooves are out of phase so that concave surfaces thereof face each other, thereby defining coupled reinforcement.

25. A container according to claim 16, wherein all of said channels have substantially the same appearance when viewed from the side while the container is standing, whereby the illusion of having more support feet than the container actually has is created.

26. A container according to claim 16, whereby said channels define a number of discrete panels on said lower end of said main body portion, and wherein each of said panels has a lower end that merges into one of said support feet, each of said panels having a generally arcuate shape.

27. A container according to claim 26, wherein said arcuate shape is concave as viewed from the bottom portion toward the finish portion.

28. A container according to claim 26, wherein said arcuate shaped panels are aligned so as to create a generally sinusoidal pattern that has a reinforcing effect.

29. A container according to claim 16, wherein said first set of undulating grooves have both an axial component and a circumferential component.

30. A container according to claim 16, wherein said first set of undulating grooves are oriented generally axially.

31. A container according to claim 30, wherein said first set of undulating grooves are generally sinusoidal.

32. A container according to claim 16, wherein said undulating grooves are generally sinusoidal.

33. A plastic container according to claim 16, wherein said first set of grooves undulate periodically.

34. A plastic container according to claim 33, wherein adjacent grooves of said first set of undulating grooves are out of phase.

* * * * *

UNITED STATES PATENT AND TRADEMARK OFFICE

CERTIFICATE OF CORRECTION

PATENT NO. : 5,988,417
DATED : November 23, 1999
INVENTOR(S) : Cheng et al.

It is certified that error appears in the above-identified patent and that said Letters Patent is hereby corrected as shown below:

Title page,
Item [57], replace the "ABSTRACT" with the following:
-- A plastic container designed for optimal strength and lightweighting characteristics includes a finish portion, a bottom portion that has support feet and a corresponding number of grooves defined between the support feet, and a main body portion. The main body portion has grooves defined in its smooth label area for permitting condensate to drain from the label portion, thereby reducing the potential for condensation-induced label delamination. The main body portion also has a tapered neck portion that has undulating grooves to provide structural reinforcement. In addition, the main body of the container also has a lower end having generally axially extending channels that extend toward the bottom portion. Some of these channels merge into grooves on the bottom portion, and others terminate before reaching the bottom portion. The channels provide structural reinforcement without increasing the number of support feet and grooves on the bottom portion. --

Signed and Sealed this

Fifth Day of November, 2002

*Attest:*

*Attesting Officer*

JAMES E. ROGAN
*Director of the United States Patent and Trademark Office*